US010156398B2

(12) United States Patent
Cory

(10) Patent No.: US 10,156,398 B2
(45) Date of Patent: Dec. 18, 2018

(54) VORTEX TUBE DRYER

(71) Applicant: Mark David Cory, Bluffton, SC (US)

(72) Inventor: Mark David Cory, Bluffton, SC (US)

(73) Assignee: Lummus Corporation, Savannah, GA (US)

( * ) Notice: Subject to any disclaimer, the term of this patent is extended or adjusted under 35 U.S.C. 154(b) by 0 days.

(21) Appl. No.: 15/605,529

(22) Filed: May 25, 2017

(65) Prior Publication Data

US 2017/0343283 A1 Nov. 30, 2017

Related U.S. Application Data

(60) Provisional application No. 62/341,406, filed on May 25, 2016.

(51) Int. Cl.

| | |
|---|---|
| ***F26B 17/10*** | (2006.01) |
| ***F26B 3/10*** | (2006.01) |
| ***B07B 7/086*** | (2006.01) |
| ***B08B 7/02*** | (2006.01) |

(52) U.S. Cl.

CPC ..... *F26B 17/102* (2013.01); *B07B 7/086* (2013.01); *B08B 7/02* (2013.01); *F26B 3/10* (2013.01); *F26B 17/107* (2013.01)

(58) Field of Classification Search

CPC ..... F26B 17/102; F26B 3/10; F26B 17/107; B07B 7/086

USPC ..... 34/182

See application file for complete search history.

(56) References Cited

U.S. PATENT DOCUMENTS

| | | | | |
|---|---|---|---|---|
| 2,363,281 | A * | 11/1944 | Arnold | F26B 17/107 159/4.06 |
| 2,724,686 | A * | 11/1955 | Nicholson | B01J 8/189 208/150 |
| 3,766,661 | A * | 10/1973 | Bayens | B04C 5/24 34/168 |
| 4,101,263 | A * | 7/1978 | Lumpkin, Jr. | C10B 49/12 110/263 |
| 4,395,830 | A * | 8/1983 | Lockwood | F26B 3/082 34/191 |
| 5,533,276 | A | 7/1996 | Vandergriff | |
| 5,915,814 | A * | 6/1999 | Crews | B04C 5/08 34/166 |
| 6,282,809 | B1 * | 9/2001 | Sunde | F26B 5/04 34/135 |
| 6,405,454 | B1 * | 6/2002 | Kramer | F26B 17/124 34/181 |

(Continued)

FOREIGN PATENT DOCUMENTS

| | | | | |
|---|---|---|---|---|
| GB | 2392115 A * | 2/2004 | | B01D 45/14 |
| WO | WO 02100516 A3 * | 10/2003 | | B01D 45/14 |

OTHER PUBLICATIONS veal-ip.com webpage printed Mar. 17, 2018.*
veal-ip.com practice areas webpage printed Mar. 17, 2018.*

*Primary Examiner* — Stephen M Gravini
(74) *Attorney, Agent, or Firm* — Laurence P. Colton; Smith Tempel Blaha LLC

(57) ABSTRACT

A vortex dryer for fibrous material utilizes a helical inlet to the base of a central vortex tube to separate fiber from debris by abruptly changing direction of the conveying air flow. The dryer combines the helical input with helical shaping of the air flow through the central vortex tube to induce greater drying for the fiber which is continued at the top of the vortex tube through a separate drying chamber.

22 Claims, 14 Drawing Sheets

(56) References Cited

U.S. PATENT DOCUMENTS

| | | | | |
|---|---|---|---|---|
| 2003/0000186 | A1* | 1/2003 | West | B01D 45/14 55/459.1 |
| 2003/0201646 | A1* | 10/2003 | Kaploun | H02K 7/183 290/54 |
| 2017/0343283 | A1* | 11/2017 | Cory | F26B 17/102 |

* cited by examiner

VORTEX TUBE DRYER

This application claims priority from U.S. Provisional Patent Application Ser. No. 62/341,406, entitled VORTEX TUBE DRYER, filed May 25, 2016.

FIELD OF THE INVENTION

This invention relates to a novel drying system for fiber or other light-weight material such as seed cotton. The invention further relates to separating rocks or other heavy foreign matter from the light weight material in the process. In particular, this invention relates to the construction of a separator with unique features incorporated to achieve these objectives, while minimizing the energy losses traditionally associated with each.

BACKGROUND

The process of picking cotton and thereafter removing seeds, trash and other foreign materials from the seed cotton is well known and understood by those familiar with the art. After seed cotton is harvested, it is then transported from the field to a cotton ginning facility. This facility has apparatus for receiving the seed cotton, drying and cleaning the seed cotton, removing the seeds from the cotton fiber or lint, cleaning the lint, and pressing the lint into bales for transport to warehousing, and later sold, commonly processing into yarn, thread, and fabric.

It is important to note that seed cotton is normally conveyed pneumatically through much of the drying process with many systems including more than one stage in the drying process. Another point to consider is whether the conveying air is of a positive pressure, a negative pressure, or some combination of the two. Those familiar in the art commonly refer to positive pressure systems as push systems, and negative pressure systems as pull systems or pull-through systems.

It is well understood cotton can be processed more easily and safely at certain levels of humidity, or moisture content. It is also well understood by those skilled in the art that the exchange of moisture into or out of seed cotton is promoted when there is a relative movement between the seed cotton and the heated conveying air.

Early in the mechanical stages used in the type of cotton ginning facility wherein the present invention might be useful is a device known as a rock trap or rock catcher, which separates rocks, green cotton bolls, and heavy foreign material from the pneumatically conveyed seed cotton as seen in FIG. 1. As seen in FIG. 1, the seed cotton is pneumatically conveyed through a conduit to an area where this separation is traditionally achieved with a hopper-type rock trap 10 which operates by abruptly expanding the cross-sectional area of the conduit and thus the negative-pressure conveying air stream and placing a deflector panel 11 in the direct path of the seed cotton and hot air stream. The deflector panel 11 directs the rocks and other heavy matter downward to an air-lock 12 and out of the system. Most of the seed cotton is light enough to be picked back up by the negative-pressure air stream as it passes around the deflector panel 11, and is then accelerated back into a conduit of similar cross-sectional area as was employed before the seed cotton entered the rock trap 10. A relatively small amount of seed cotton does not get picked back up by the hot air stream and falls down toward the air-lock. The air-lock is commonly either of a rotary design 13 or of a double-door design 14, with one door 14*a* separated by a small chamber over another door 14*b* where only one door opens at a time. Those in the industry often refer to rotary air locks as either vacuum droppers or vacuum wheels.

In an effort to minimize the amount of seed cotton lost in this process, an adjustable air inlet 15 is employed allowing ambient, cold air to reclaim the seed cotton and send it upward away from the air-lock and back into the conveying air stream. Energy is lost in this process in multiple ways. First the deflector panel creates a significant pressure drop; secondly the ambient air introduced to reclaim lost seed cotton dilutes the heat of the conveying air, thus reducing the drying capacity, and finally the energy required to pull in and accelerate this ambient air creates yet another pressure drop.

It must be acknowledged that in an effort to reduce the losses at the hopper-type rock trap, an innovative system was successfully developed wherein a secondary hot air stream was introduced immediately after the deflector to keep the conveying air warm and introduce additional turbulence to enhance the drying process. This approach was applied in many installations and helped improve the system efficiency, but all of the other losses described above remained. This approach also introduced the need for additional ductwork and complexity regarding air-balance, and introduced the opportunity for compromising the conveying air stream velocity by virtue of the pull air coming in through the secondary hot air stream inlet at the rock trap. That is to say, the air intake at the secondary inlet can reduce the effectiveness of the upstream air flow by reducing the pressure differential upstream of the rock trap.

FIG. 2 shows another type of rock trap known generically as a conveyor-belt suction-duct-type 20 which can be employed at the point where the seed cotton initially enters the air stream. In the better versions of this arrangement, hot air is pulled into a plenum chamber integrated into the suction-duct. In worst cases, the cotton is picked up with ambient air much like a large vacuum cleaner and almost immediately dropped into an elevated feed hopper without the benefit of any heating at all, thus adding to the overall system energy requirements. In the former case, ambient air is also pulled into the system, thus diluting the hot conveying air in such a way as to normally be less efficient than the previously described hopper-type rock trap 10.

While the number and type of components in drying systems vary from one facility to the next, some common system components can be seen in FIG. 3 and FIG. 4. It is not uncommon for the device following the rock trap to be either a shelf-type tower dryer 30 as taught by Bennett in U.S. Pat. No. 2,189,099 or some other type of large vessel 40 as taught by Jackson in U.S. Pat. No. 4,845,860, with either being designed to slow down the velocity of the seed cotton and allow slippage of the hot conveying air over and through the seed cotton. In many cases there is a necessary change in elevation between the outlet of the rock trap 10 and the inlet of the dryer. As a result, the ductwork between these two devices commonly contain at least two or three elbows 41 and some straight sections 42, each creating additional pressure drops.

It should also be noted the rock traps described above all operate primarily in drying systems using a negative pressure conveying air stream, or pull-through designs. By virtue of the need for the introduction of the reclaiming air above the air-lock, these systems do not easily lend themselves to positive pressure conveyance, or push designs.

SUMMARY OF THE INVENTION

An object of the present invention is to offer a simple, novel device for removal of rocks and green cotton bolls that can be used in systems employing either positive or negative conveying air streams.

It is another object of this invention to incorporate the rock trap and dryer into one device, thereby removing the connecting ductwork and elbows between these two functions and reducing the energy losses introduced by such ductwork and elbows connecting the two. This also reduces the footprint for both of these functions.

A further object of this invention is to devise a means for separating the rocks and green cotton bolls using a cyclonic inlet, thus reducing the energy requirements for this step of the process as compared to the traditional hopper-type rock trap.

Yet another object of this invention is to convey the seed cotton out of the rock trap and into the dryer chamber without, or essentially without the need for the introduction of reclaiming air, reducing the energy losses as compared to traditional systems.

It is another object of this invention to introduce a spiraling motion for the seed cotton throughout the entire device to promote a tumbling action for each individual lock of seed cotton, thereby exposing multiple faces of each lock of seed cotton to the hot conveying air stream, thereby increasing the relative motion between the seed cotton and the conveying air stream, thus improving drying efficiency. This spiraling motion begins at the inlet of the rock catcher, continues through a central vortex equipped with spinner vanes, and is encouraged to continue in a spiral path due to the unique ceiling of the dryer chamber, and also at the exit of the dryer.

A further object of this invention is to create a central, rotating vertical column of conveying air within the dryer chamber with the vertical column eventually being separated by a centrally suspended cone to create a distribution of seed cotton around the perimeter of the chamber prior to its downward path; the ceiling of the dryer chamber being of a curved shape such that it encourages the seed cotton path to take on the shape of a torus, or doughnut, thereby inducing a compound direction of spin for each lock of seed cotton, thus further improving drying efficiency in the manner described previously. By virtue of the centrally rising column of conveying air and seed cotton piercing the path falling down around the perimeter, a cylindrically shaped pneumatic sheer zone is created where the two pass each other, one inside the other as seen from above, this sheer zone further increasing turbulence at the boundary layer between the two and furthering the encouragement of the continuation of a torus-shaped path of the descending seed cotton.

BRIEF DESCRIPTION OF THE DRAWINGS

Referring to the drawings which are appended hereto and which form a portion of this disclosure, it may be seen that.

DETAILED DESCRIPTION

Figure 1:
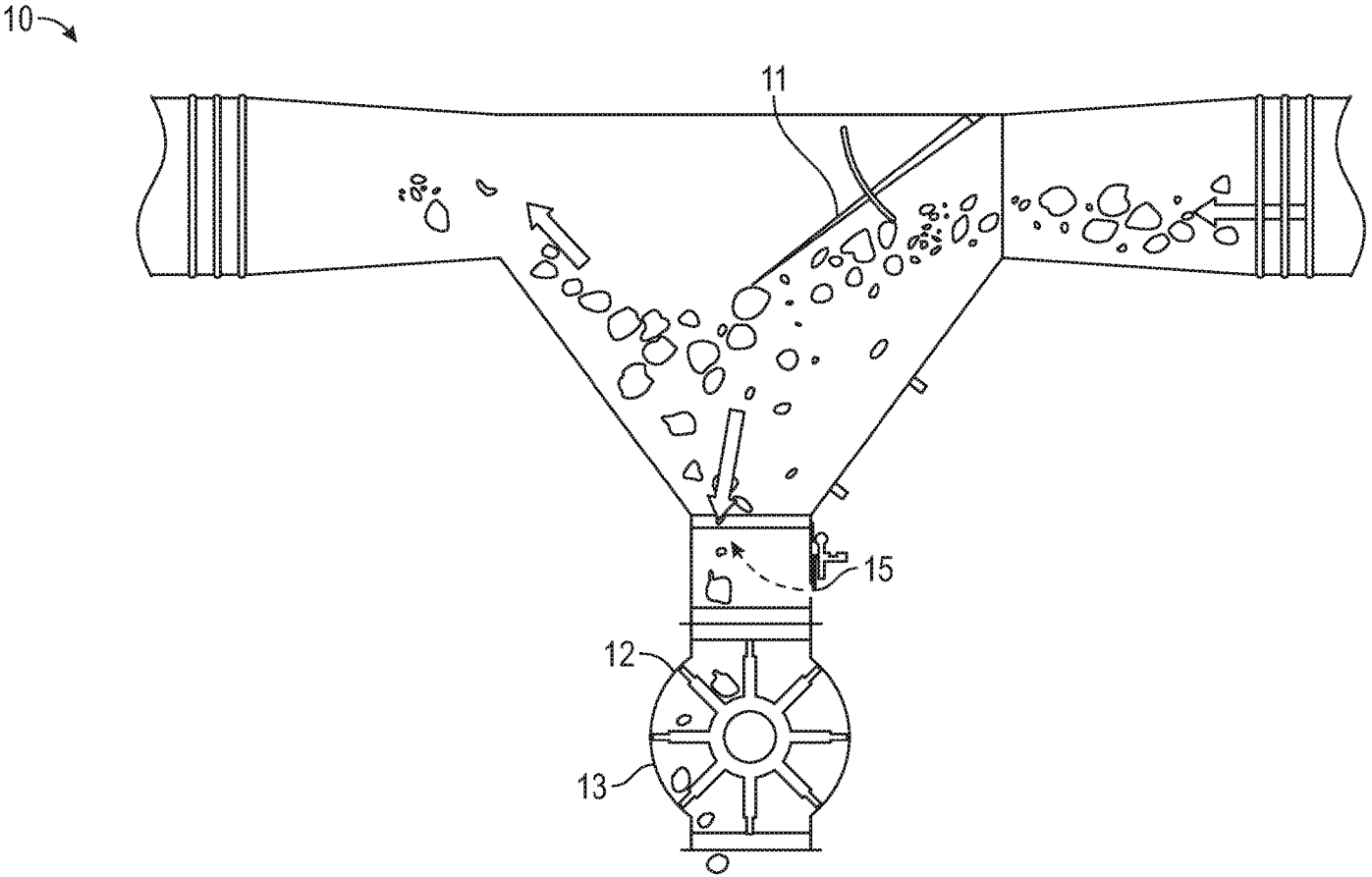
FIG. 1 (Prior Art)
FIG. 1 is a side cross section view of a traditional prior art hopper-type rock and green boll trap.
Figure 2:
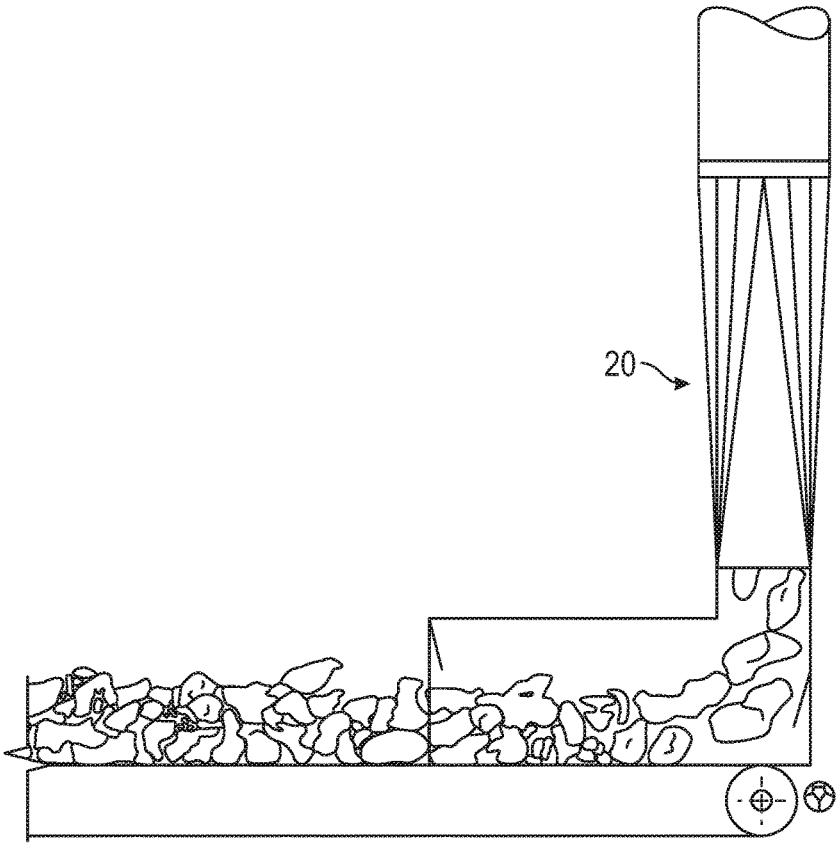
FIG. 2 (Prior Art)
FIG. 2 is a sectional view of a traditional prior art conveyor-belt suction-duct-type rock and green boll trap.
Figure 3:
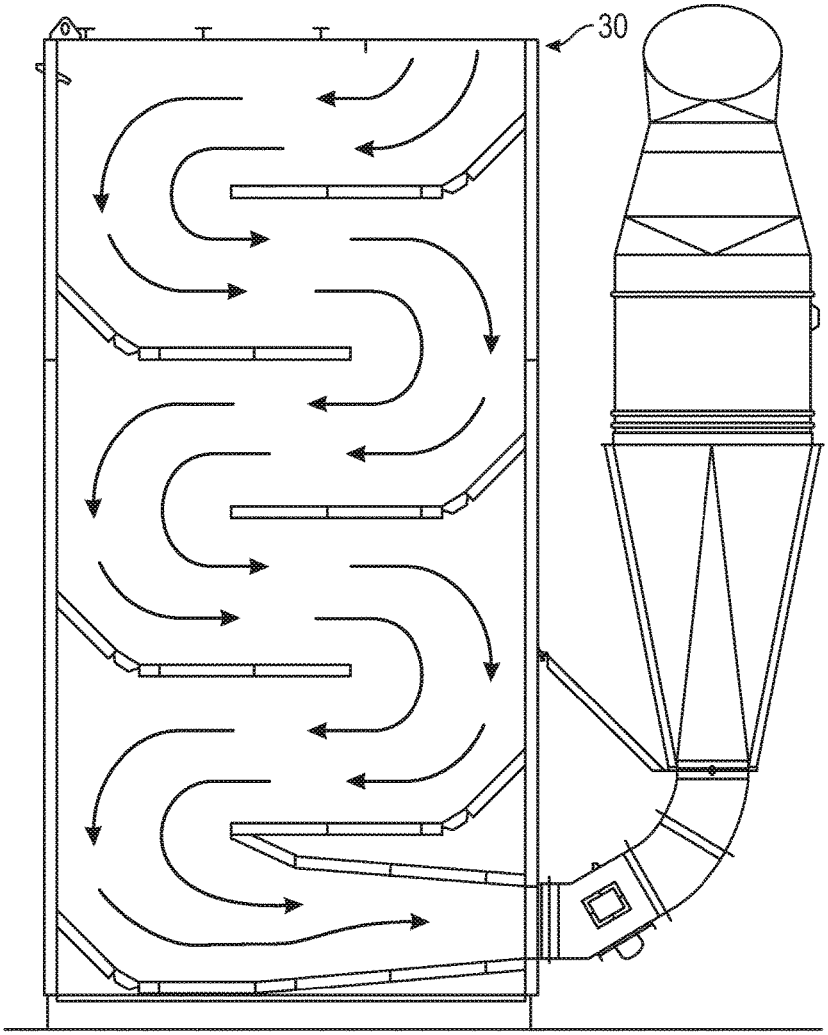
FIG. 3 (Prior Art)
FIG. 3 is a sectional view of a traditional prior art shelf-type tower dryer.
Figure 4:
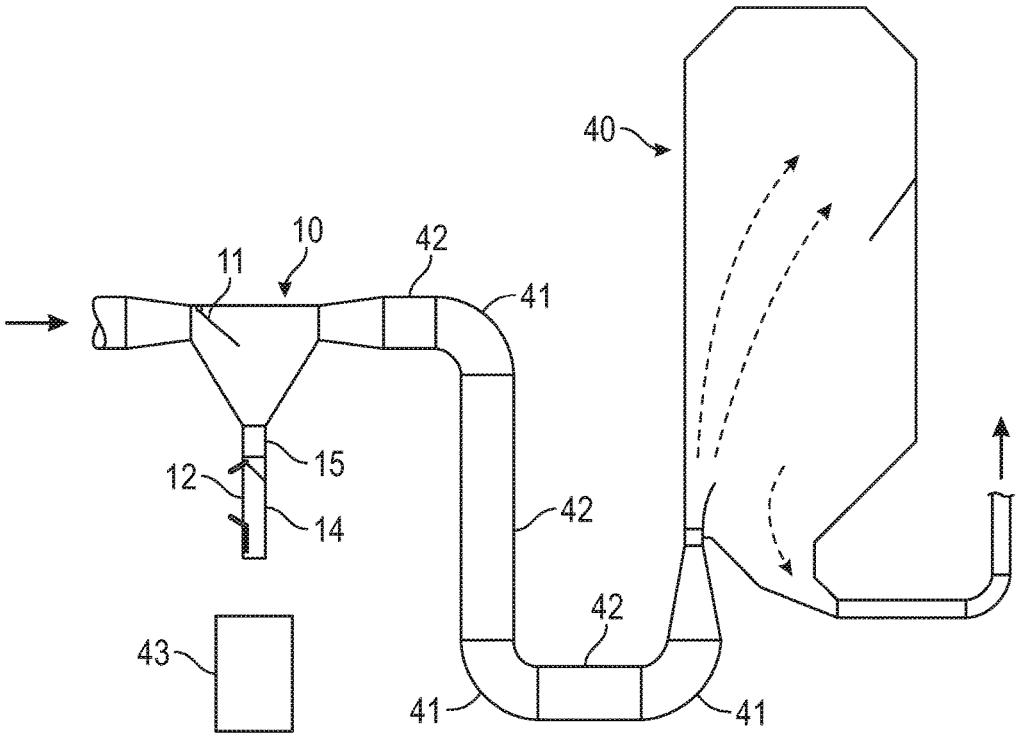
FIG. 4 (Prior Art)
FIG. 4 is a sectional view of a hopper-type rock trap followed by a traditional open-cavity dryer.
Figure 5:
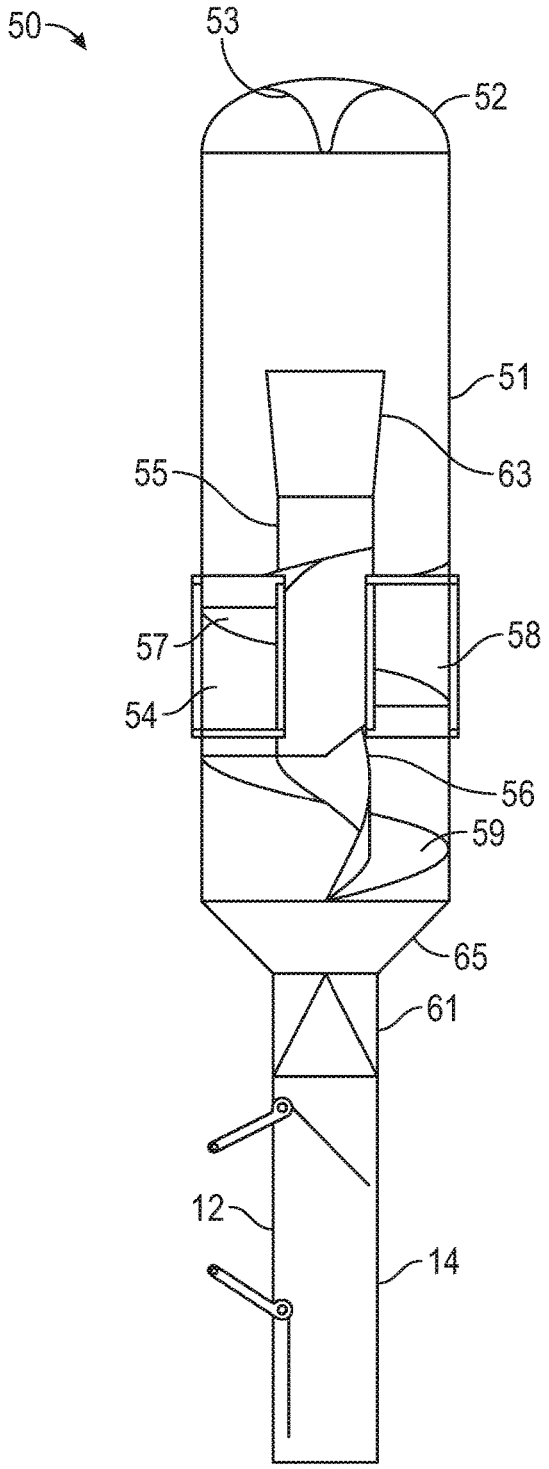
FIG. 5 is a front sectional showing the overall view of a first embodiment of present invention.
Figure 6:
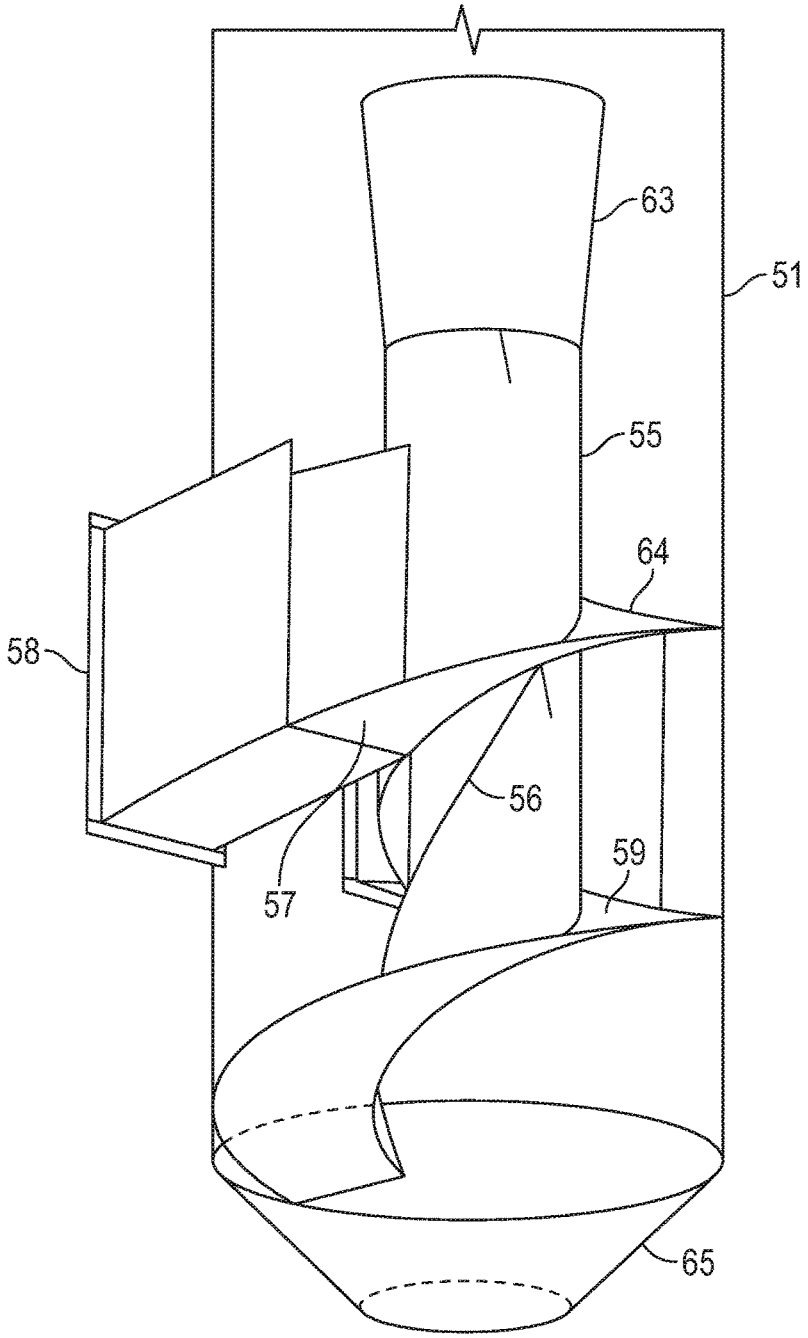
FIG. 6 is an orthographic view of the tangential inlet outlet, and vortex tube of the embodiment of FIG. 5.

One or more of the above objects can be achieved, at least in part, by providing a vortex tube dryer 50 including a cylindrical body 51 with a head 52 of dished or concave shape containing a suspended splitter cone 53. An inlet 54 allows seed cotton and air to enter the cylindrical body 51 in a tangential manner into a ductwork with a rectangular cross section defined by an upper wall 57, a lower wall 59, an inside wall **55*a*, and an outside wall 60, This ductwork causes the airflow and entrained seed cotton to follow a downward spiraling path. The inside vertical wall of this rectangular cross section wraps around a central vertical vortex tube 55. As the inlet path wraps downward around the vortex tube 55, the cross section enlarges thus reducing the velocity of the hot air and seed cotton. This enlargement can be achieved in more than one way. One means of enlargement by the upper wall 57 of said rectangular inlet duct leveling out to form the lower floor of the superjacent outlet 58, thereby increasing the vertical height of the rectangular inlet duct. Another means of enlargement by the introduction of a gradually tapered spiral opening 56 in the inner wall 55*a* coincident with the outer wall of the vortex tube 55. The tapered opening 56 or vortex tube inlet creates a sharp turn for the hot air and seed cotton. The lower wall 59 of the rectangular inlet duct continues downward in the same spiral fashion until terminating near the bottom of the cylindrical body 51. FIG. 6** further illustrates several of these components.

The separation of rocks, green bolls, and heavy foreign matter takes place below the inlet 54 by virtue of two actions; first the heavier-than-seed-cotton material tends to follow the outer wall 60 of the tangential inlet and such that the inlet duct acts like a cyclone tending to sling the heavy material outward as the air follows a circular path, and secondly the difference in the mass of the individual locks of seed cotton and the basic momentum formula for an object of $p=mv$, where p represents momentum, m represents mass of the object and v represents velocity of the object. The smaller mass seed cotton has less momentum and tends to follow the air stream into the tapered spiral opening 56, thus, the seed cotton is peeled away from the trajectory of any more massive materials, such as rocks and green bolls, which are unable to make the sharp turn due to their higher momentum. The separation action of a cyclone is well understood by those familiar with the art.

A cone 65 is attached to the bottom of the cylindrical body 51, and below the cone 65 is a round to rectangular transition 61. Below the transition is an air lock 12 either of a rotary design 13 or of a double-door design 14. The rocks and green bolls are then dropped out of the system into a barrel 43, some other suitable container, or some other means of conveyance.

Figure 7:
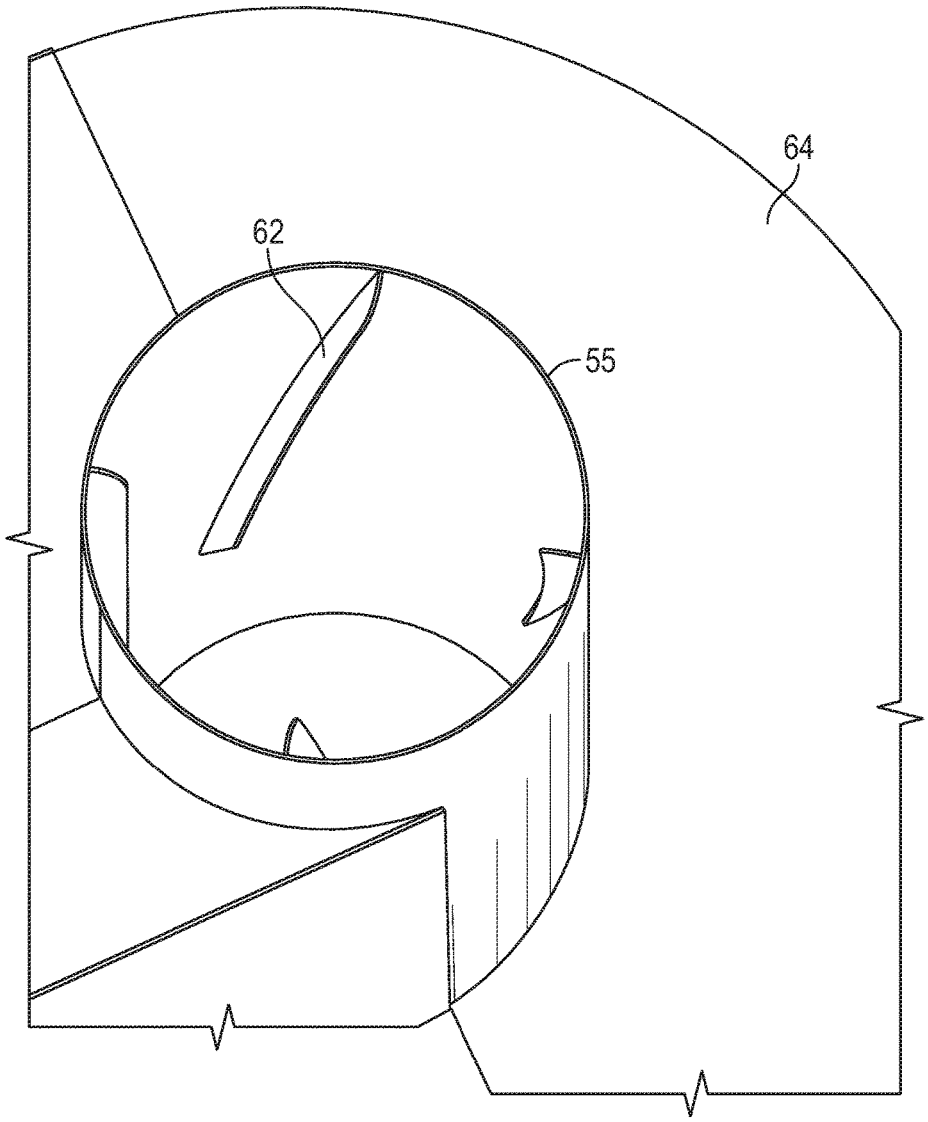
FIG. 7 is an orthographic view showing the vortex tube with the diffuser nozzle removed of the first embodiment.
Figure 9:
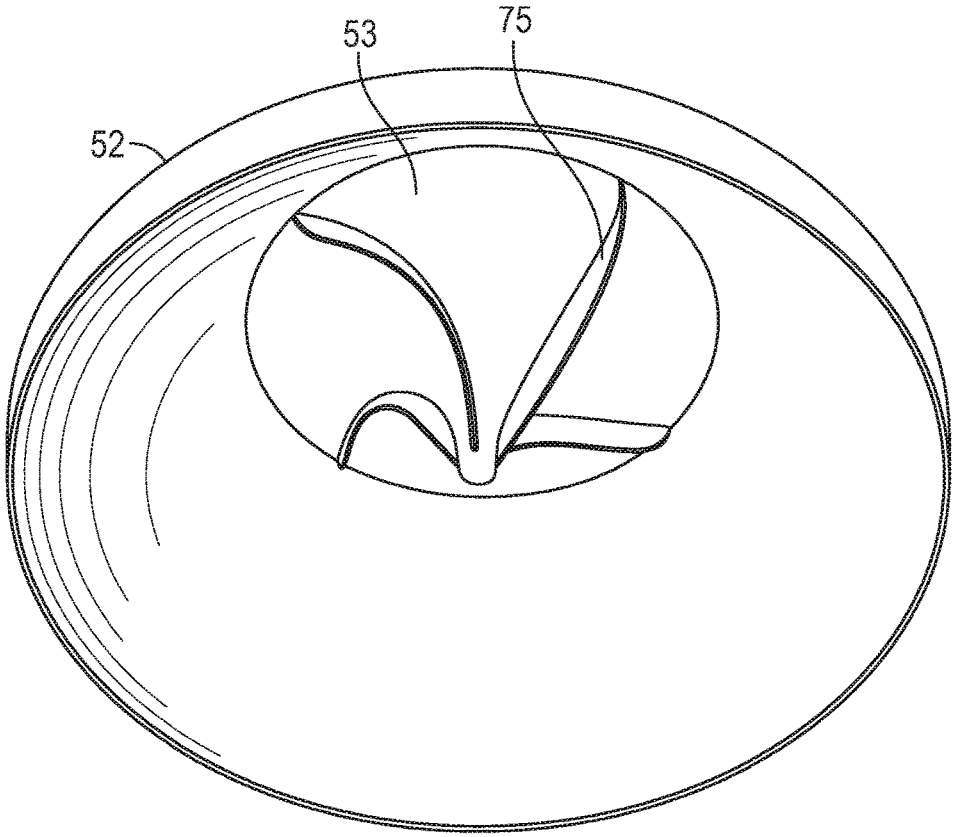
FIG. 9 is a bottom view of the dished head and splitter cone.

The velocity of the hot air and seed cotton entering the vortex tube 55 increases due to the decrease in cross sectional area. The inside of the vortex tube 55 can be seen in FIG. 7. The vortex tube 55 contains helical spinner vanes 62 extending inwardly and diagonally relative to the vortex tube, which will encourage the continued spiral path of the hot air and seed cotton. Above the vortex tube is a diffuser nozzle 63 designed to reduce the pressure drop as the hot air and seed cotton enter the relatively larger cross section created by the cylindrical body 51. As the rising column of seed cotton reaches the splitter cone 53 and dished head 52 it will spread around the perimeter wall of the cylindrical body prior to falling back down onto the spiral exit ramp floor 64 created by virtue of being the other side of the material used to make up the upper wall 57 of the rectangular inlet 54. The concomitant motion of the centrally rising column of conveying air and seed cotton exiting the vortex tube and the descending air moving toward the tangential outlet 58 create a cylindrically shaped pneumatic sheer zone where the air moving in opposite vertical directions pass each other, one inside the other as seen from above, thereby further increasing turbulence at the boundary between the two and furthering the encouragement of the continuation of a torus-shaped path of the descending seed cotton. The rectangular tangential outlet 58 is formed on the bottom by the spiral exit ramp floor 64, on the outside by the wall of the cylindrical body 51, and on the inside wall by the vortex tube 55. Optionally, a series of spinner vanes 75 can be affixed to the surface of the splitter cone 53 arranged in a spiral pattern, as seen in FIG. 9, thus encouraging the seed cotton to continue in spiraling path as it traverses the dished head 52. It is understood the head 52 can be dished, spherical, elliptical, or flat and still maintain the spirit thereof.

Figure 8:
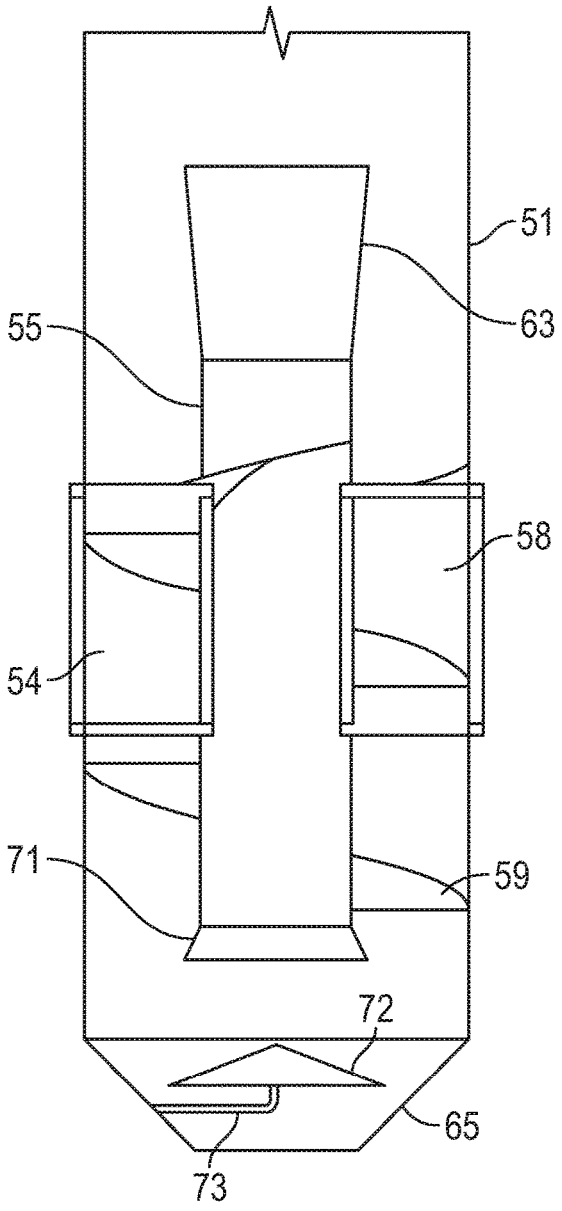
FIG. 8 is a sectional view of a second embodiment of the inlet of the vortex tube, the lower end of the cylindrical body, and the cone above the air lock of the present invention.

A second embodiment of the present invention can best be seen in FIG. 8 where the inlet of the vortex tube 55 does not have a tapered spiral opening. The vortex tube inlet can optionally include an inlet nozzle 71. Directly below the vortex tube inlet is an optional vortex breaker 72 that can be conical, spherical, elliptical or flat in cross section. This vortex breaker 72 can be supported from beneath, and this support 73 can also be adjustable to place the vortex breaker 72 in an optimal position. It is to be understood that support 73 can include hydraulic or mechanical actuators to move the vortex breaker horizontally and vertically in a known manner. The vortex breaker 72 adjustment can include not only a change in elevation, but can include provision for a location change bringing the vortex breaker into a position no longer central to the cylindrical body 51 or the cone 65 or the vortex tube 55. This adjustment can also allow for a change in angular position of the central axis of the vortex breaker 72 relative to the cylindrical body 51 or the cone 65 or the vortex tube 55. It is understood all or some features unique to the second embodiment can be combined or included with features described in the first embodiment and still maintain the spirit thereof.

It is understood the cylindrical body or housing 51 in any of the embodiments described herein can be made up of a multi-faceted wall with as few as four facets instead of having a smooth, curving surface wall and some components could also be faceted in a similar manner and still maintain the spirit thereof.

Figure 10:
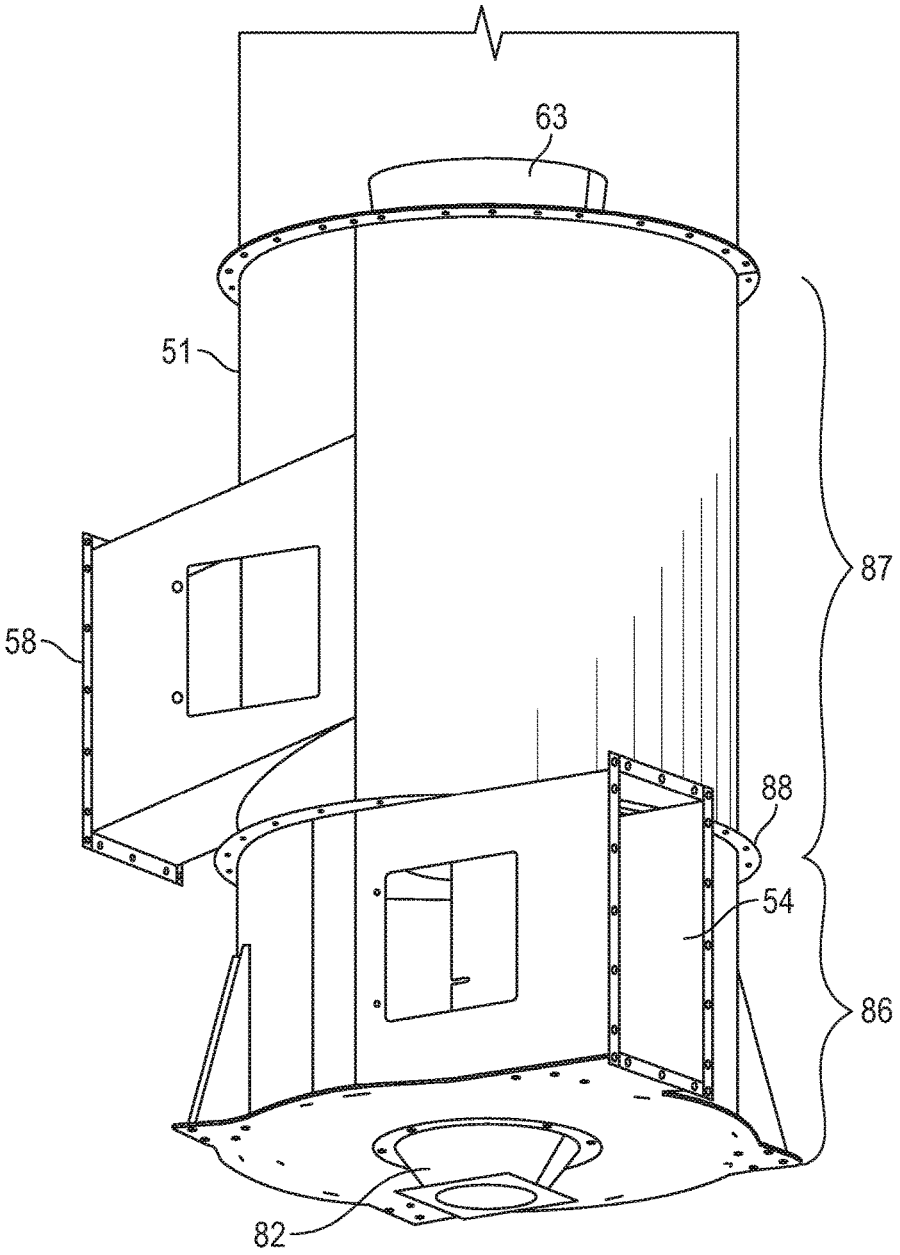
FIG. 10 is a partial perspective view of the dryer.
Figure 11:
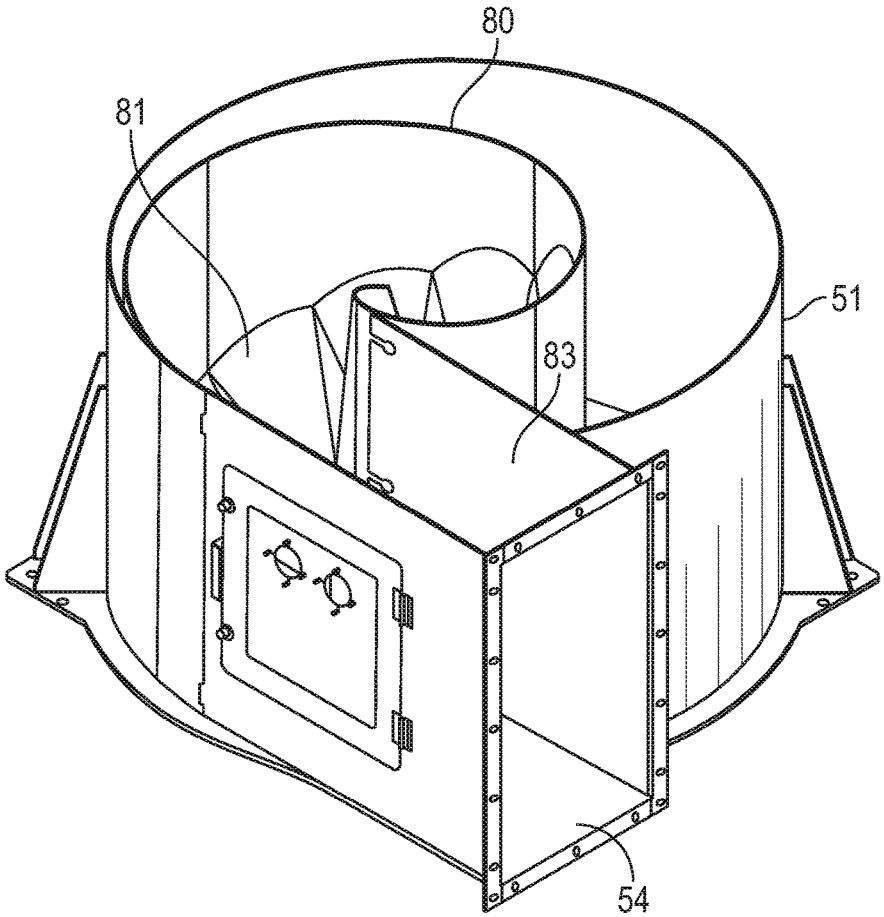
FIG. 11 is a perspective view of the separating chamber of the third embodiment.
Figure 14:
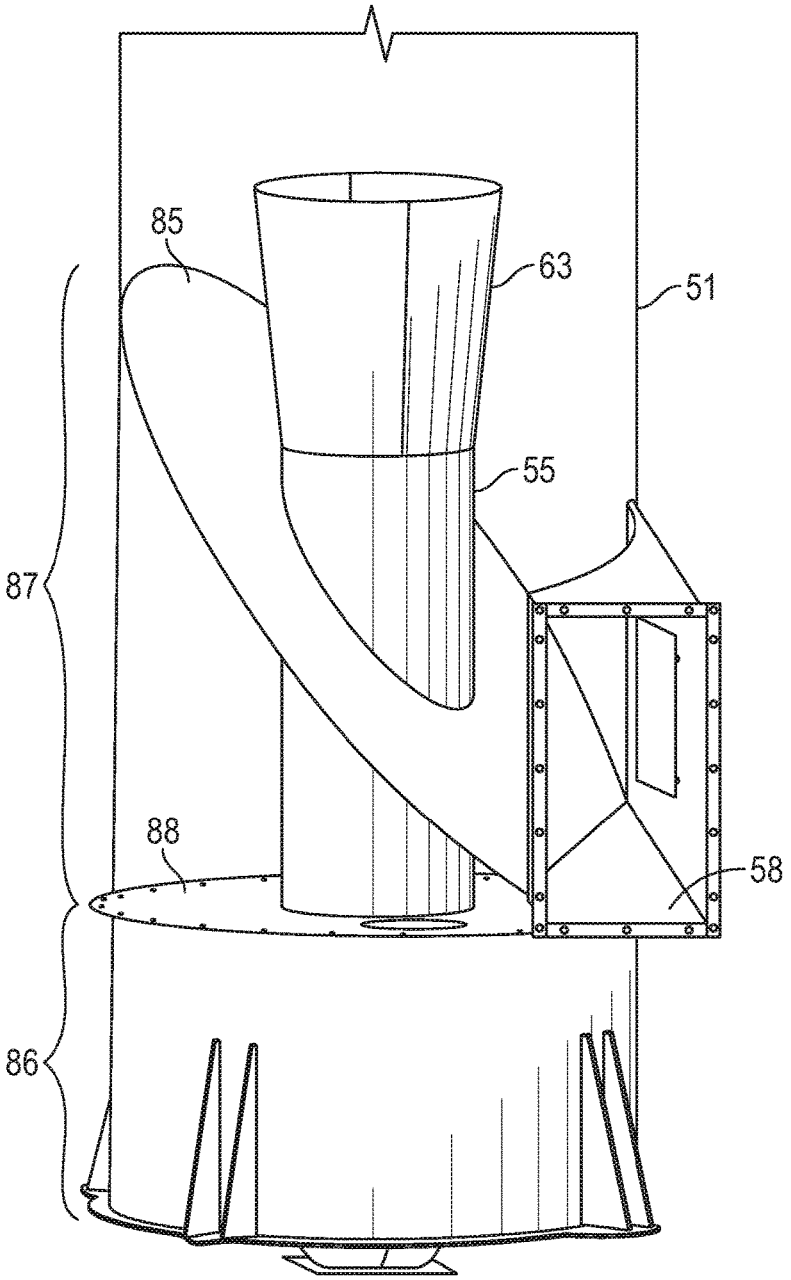
FIG. 14 is a partial sectional view of the drying chamber of the third embodiment.

A third embodiment of the present invention can be seen in FIG. 10 and FIG. 14 where the tangential inlet 54 and tangential outlet 58 are at significantly differing elevations. The inlet section 86 of this embodiment is separated from the outlet section 87 by a solid divider sheet 88 with a central hole of the same diameter as the vortex tube 55. This divider sheet 88 forms the roof of the inlet section 86 and serves as the origination of the inlet point of the vortex tube 55. A tangential inlet 54 enters the cylindrical body 51 near the bottom and the spiral inlet path points upward. As seen in FIG. 11 this upward directionality is achieved by combining an involute scroll-type vertical wall 80 and radially upward ramping floor 81 in order to encourage the seed cotton to begin the spiraling motion immediately prior to entry into the central vortex tube as shown in previous embodiments. By radially upward ramping, we mean that the portion of the floor closest to the involute scroll is higher than the distal portion closest to the axis of the vertical tube. Further the angle of inclination of the upwardly ramping floor increases as the involute spiral wall curves toward the vortex tube. Thus, the upward ramping floor 81 increases in angular pitch from the central axis of the vortex tube such that as the path of the involute wall 80 approaches completion of 180 degrees of rotation around the central axis, the floor angle becomes parallel to the wall forming a partial near-cylindrical area immediately beneath the vortex tube. In addition to inducing the spiraling motion of seed cotton, this shape creates a somewhat gradual transition in cross-sectional area between the tangential inlet of the cylindrical body and the inlet at the bottom of the vortex tube in order to accelerate the seed cotton in such a manner as to minimize the energy losses associated with abrupt pressure drops and undesirable eddy currents.

While the seed cotton is carried immediately upward into the accelerating air stream entering the vortex tube, the relatively heavier items like rocks or green bolls tend to follow the outer wall of the involute scroll, in an ever-tightening path toward the center where it will tend to reduce in velocity, drop out of the conveying air stream, fall into a cone 82 attached to the floor at the bottom of the cylindrical body, drop into air lock 12, and exit the system as demonstrated in previously described embodiments.

Figure 12:
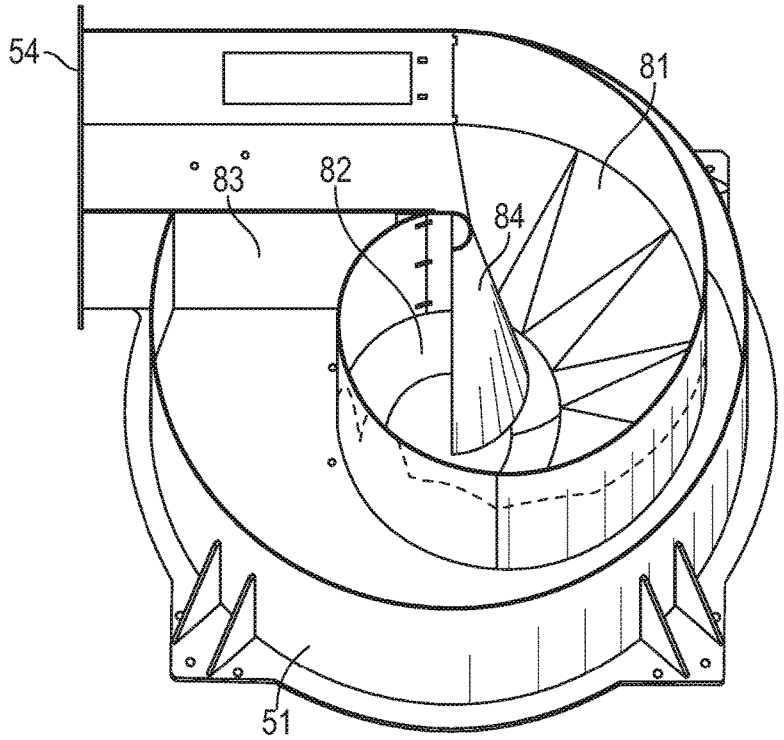
FIG. 12 is an upper perspective view of the separating chamber of the third embodiment showing the conic scroll extension of the inner wall.
Figure 13:
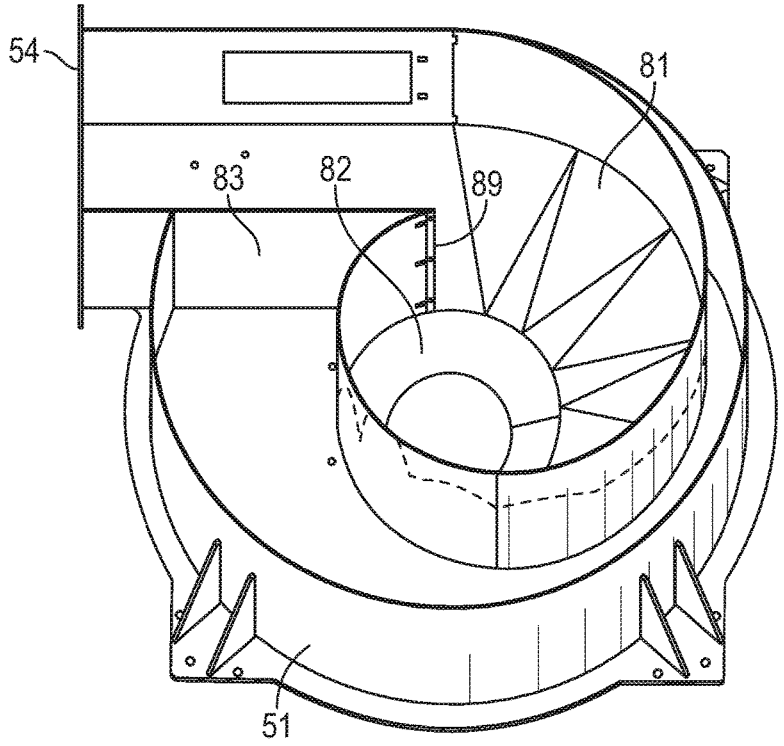
FIG. 13 is an upper perspective view of the separating chamber of the third embodiment.

The vertical walls of the tangential inlet are defined on the outside by the involute scroll 80, and on the inside by a vertical wall 83 that ends near the point where the plane defined by this inside wall meets at or near the tangent point 89 of the downward imaginary cylindrical projection of the wall of the vortex tube immediately above. This inner wall 83 can stop abruptly at this tangent point 89 as best seen in FIG. 13, or can be fitted with a variety of scroll extensions as best seen in FIG. 12 so shaped to prevent the separated matter like rocks and green bolls from being reintroduced into the air stream entering the vortex tube. One such scroll extension could be described as a portion of a cylinder or as the continuation of the ever-tightening involute scroll. Another shape could be described as a portion of a cone whose defining axis runs parallel or nearly parallel with the vortex tube. A cone version of this scroll extension 84 could be designed pointing up or down. It is understood portions of the above described scroll extensions could be cut away or extended as required to obtain the desired results described herein.

The outlet section 87 can best be understood as seen in FIG. 14 and is formed with the floor of the outlet being defined by a single or compound diagonal plane whose lower end terminates immediately prior to the rectangular tangential outlet 58, with said plane forming a singular canted disc 85 whose center is removed in such a way as to allow the cylindrical path of the vortex tube 55 to pass through this plane, and sealed both to the vortex tube and the inner walls of the cylindrical body 51 in order to maintain air pressure isolation between the inlet and outlet of the dryer.

Alternatively for this third embodiment, the outlet section 87 could be replaced and rectangular tangential outlet 58 formed as best shown in FIG. 6. with the spiral exit ramp floor 64 as demonstrated in a previously described embodiment.

Figure 15:
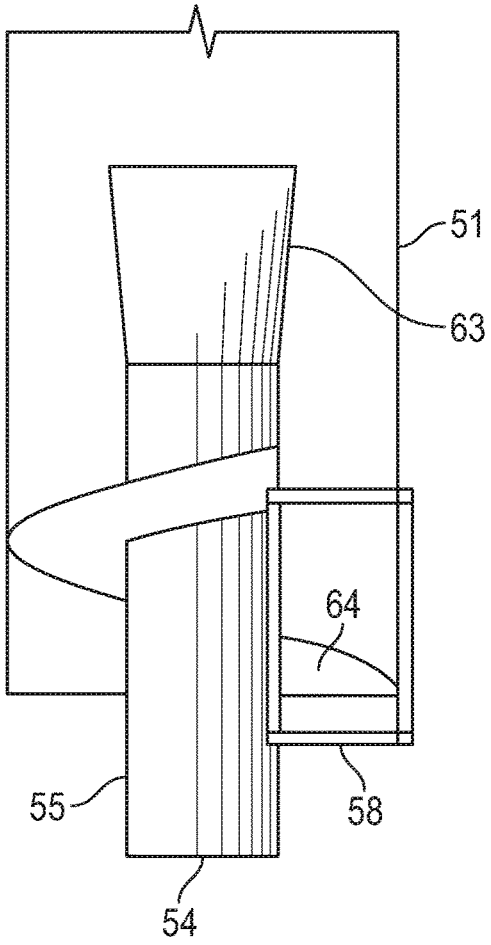
FIG. 15 is a diagrammatic view of a fourth embodiment.

A fourth embodiment of the present invention can be seen in FIG. 15 wherein the inlet 54 of the dryer is coincidental with the inlet point of the vortex tube 55. The spiral exit ramp floor 64 and dryer tangential outlet 58 remain as demonstrated in previously described embodiments and shown in FIG. 6 and FIG. 14.

Alternatively for this fourth embodiment, the outlet section could be formed with the floor of the outlet being defined by a single or compound diagonal plane whose lower end terminates immediately prior to the tangential outlet 58, with said plane forming a singular canted disc 85 whose center is removed in such a way as to allow the cylindrical path of the vortex tube 55 to pass through this plane as best shown in FIG. 14. While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What I claim is:

1. A vortex dryer for a fluid conveyed fiber, wherein a tubular housing contains a vertical central tube, the vertical central tube defining an interior between a top end and a bottom end, the vertical central tube partially circumscribed by a spiraling inlet housing in fluid communication with the bottom end of the vertical central tube, the bottom end superjacent a discharge for heavier trash and debris, the vertical central tube comprising a plurality of helical vanes situated about the interior of the vertical central tube, wherein the plurality of helical vanes promotes helical flow of the fluid conveyed fiber, upward through the vertical central tube, wherein the tubular housing includes a head forming a diverter dish for directing fluid conveyed fiber outwardly and downwardly to a tangential fiber discharge outlet.

2. A dryer for a fiber entrained in an airstream, wherein a central vertical tube defines an air passage from a lower separating chamber to an upper drying chamber, the lower separating chamber including a spiraling intake guide, the spiraling intake guide delivering the fiber entrained in the airstream to an inlet to the central vertical tube, the central vertical tube including a plurality of helical vanes extending inwardly to promote helical flow of the fiber entrained in the airstream upwardly through the central vertical tube, the upper drying chamber including an upper deflector head, positioned above the central vertical tube, and a tangential fiber discharge outlet, positioned below the deflector head, such that airflow through the central vertical tube to the tangential fiber discharge outlet is directed downwardly toward the tangential fiber discharge outlet.

3. The dryer as claimed in claim 2, wherein the spiraling intake guide is defined by (1) an inner wall along the central vertical tube, (2) an outer wall of the separating chamber, (3) a downwardly spiraling lower wall, (4) a connecting wall extending tangentially from the central vertical tube, between the central vertical tube and the outer wall, and (5) a downwardly spiraling partition spaced above the downwardly spiraling lower wall, and separating the drying chamber from the separating chamber and defining a base of the tangential discharge outlet.

4. The dryer as claimed in claim 3, wherein the downwardly spiraling lower wall extends below the central vertical tube into the separating chamber.

5. The dryer as claimed in claim 3, wherein the central vertical tube extends below the downwardly spiraling lower wall into the separating chamber.

6. The dryer as claimed in claim 5, wherein a conic vortex breaker is disposed beneath the central vertical tube.

7. The dryer as claimed in claim 6, wherein the conic vortex breaker is mounted on an adjustable support to allow selective positioning of the vortex breaker in the separation chamber.

8. The dryer as claimed in claim 2, wherein an air lock communicates with the separating chamber and is positioned subjacent the separating chamber to remove matter dropped from the airstream.

9. The dryer as claimed in claim 2, wherein the upper deflector head includes a plurality of downwardly extending diverter vanes to direct the airstream from the outlet of the central vertical tube.

10. The dryer as claimed in claim 2, wherein a conic vortex breaker is disposed beneath the central vertical tube.

11. The dryer as claimed in claim 10, wherein the conic vortex breaker is mounted on an adjustable support to allow selective positioning of the vortex breaker in the separation chamber.

12. The dryer as claimed in claim 2, wherein the spiraling intake guide is an involute scroll positioned subjacent the central vertical tube and diminishing in radius towards the central vertical tube with the involute scroll affixed to a bottom wall with the bottom wall having a radially upward inclination increasing as the involute scroll radius diminishes.

13. The dryer as claimed in claim 12, wherein a tangential inlet for the airstream is defined by an inner wall of the involute scroll and a vertical wall spaced from the involute scroll and extending to a point immediately below the inner wall of the central vertical tube.

14. The dryer as claimed in claim 13, wherein the vertical wall extends below the central vertical tube as a conic section.

15. The dryer as claimed in claim 12, wherein the lower separating chamber and the upper drying chamber are separated by a downwardly spiraling partition with the central vertical tube passing through the downwardly spiraling partition and sealed to the downwardly spiraling partition.

16. The dryer as claimed in claim 12, wherein the upper drying chamber includes a floor inclined relative to the central vertical tube upwardly from the tangential fiber discharge outlet.

17. The dryer as claimed in claim 12, wherein the tangential fiber discharge outlet is formed by (1) an outer wall of the central vertical tube, (2) an outer wall of the upper drying chamber, (3) a floor spiraling downwardly about the central vertical tube, and (4) a connecting wall extending tangentially from the outer wall of the central vertical tube.

18. The dryer as claimed in claim 3, wherein the tangential fiber discharge outlet is formed by (1) the outer wall of the central vertical tube, (2) an outer wall of the upper drying chamber, (3) the downwardly spiraling partition forming a floor about the central vertical tube, and (4) a connecting wall extending tangentially from the outer wall of the vertical tube to the outer wall of the upper drying chamber.

19. A The dryer as claimed in claim 1, wherein the vertical central tube defines an air passage from a lower separating chamber to an upper drying chamber, and wherein the spiraling inlet housing is defined by (1) an inner wall defining the vertical central tube, (2) an inner wall of the tubular housing, (3) an outer wall of the lower separating chamber, (4) a downwardly spiraling lower wall, (5) a connecting wall extending tangentially from the vertical central tube, the connecting wall located between the vertical central tube and the outer wall, and (6) a downwardly spiraling partition spaced above the downwardly spiraling lower wall, the downwardly spiraling lower wall separating the tubular housing into the upper drying chamber and the lower separating chamber.

20. The dryer as claimed in claim 1, wherein the spiraling inlet housing is defined by an involute scroll positioned subjacent the vertical central tube and diminishing in radius towards the vertical central tube with the involute scroll affixed to a bottom wall with the bottom wall having a radially upward inclination increasing as the involute scroll radius diminishes and a vertical wall spaced from the involute scroll and extending tangentially from a point immediately below the wall of the vertical central tube to the wall of the tubular housing.

21. A vortex dryer for a fluid conveyed, fiber wherein a tubular housing contains a vertical central tube, the vertical central tube defining an interior between a top end and a bottom end, the vertical central tube including a plurality of helical vanes about its interior to promote helical flow of the fluid conveyed fiber, upward through the vertical central tube, wherein the tubular housing includes a head forming a diverter dish for directing fluid conveyed fiber outwardly and downwardly to a tangential fiber discharge outlet.

22. The vortex dryer as claimed in claim 21, wherein the tubular housing defines a drying chamber that includes a floor inclined relative to the vertical central tube upwardly from the tangential fiber discharge outlet.

* * * * *